United States Patent [19]

Morgan et al.

[11] 3,958,275

[45] May 25, 1976

[54] HELMET FOR DIVERS

[76] Inventors: Bevly B. Morgan, 3319 Braemar Drive, Santa Barbara, Calif. 93105; Robert R. Kirby, P.O. Box 665, Santa Ynez, Calif. 93460

[22] Filed: Mar. 6, 1975

[21] Appl. No.: 556,172

[52] U.S. Cl. ..... 2/2.1 R; 128/142.7

[51] Int. Cl.[2] ..... B63C 11/02

[58] Field of Search ..... 2/2.1 R, 2.1 A, 5, 6, 2/7, 8; 128/142.7, 1 B, 204, 30.2, 191 A

[56] References Cited

UNITED STATES PATENTS

| | | | |
|---|---|---|---|
| 1,264,706 | 4/1918 | Stallworth | 2/2.1 R |
| 2,394,078 | 2/1946 | Kropp | 2/2.1 R |
| 2,954,562 | 10/1960 | Kropp | 2/2.1 R |
| 3,351,056 | 11/1967 | Kurney | 2/2.1 R |
| 3,353,534 | 11/1967 | Savoie | 2/2.1 R |
| 3,786,809 | 1/1974 | Kitrilakis | 128/191 A |

*Primary Examiner*—George H. Krizmanich
*Attorney, Agent, or Firm*—Clarence A. O'Brien; Harvey B. Jacobson

[57] ABSTRACT

A head enclosing helmet structure is provided including a fluidtight front viewing window and a lower access opening for upwardly removably receiving the head of the wearer of the helmet therethrough. The outer surface portions of the helmet portions disposed about the lower access opening are generally cylindrical and an annular collar of deformably and compressible material is wedgingly removably receivable between the inner surfaces of the access opening of the helmet and the opposing neck surfaces of the wearer. A hollow tubular and endwise tapering flexible neck dam provided with a supportive radially contractable mounting ring on its major diameter end is removably clampingly engageable about the cylindrical outer surface portions of the helmet extending about the access opening therein and a generally horseshoe-shaped yoke is provided for removable disposition about the neck of the wearer of the helmet and provided with releasable anchor means for securement to the mounting ring with the portion of the neck dam disposed between its opposite ends compressively clamped between the upper surface portions of the yoke and the undersurface portions of the collar, the latter being upwardly seatingly engageable within the access opening of the helmet against the lower portions of a resilient head cushioning liner within the helmet.

8 Claims, 6 Drawing Figures

HELMET FOR DIVERS

BACKGROUND OF THE INVENTION

Previously known diving helmets designed for use without a full diving suit are substantially all equipped with a flexible, stretchable neck seal. This seal, usually made of rubber or a similar substance, is attached to a metal, or other substantially rigid material, ring. The metal ring must be large enough so that a diver's head can pass therethrough. The metal ring in turn is attached in a waterproof manner to the helmet with securement latches of various types employed to hold the neck seal and its metal ring to the helmet.

Some previously known structures of this type were secured to the head of the diver by a head harness or a chin strap, or both. Some other diving helmets are held in place by means of cables or straps that are secured to the diver's body, then attached to the lower part of the helmet.

These known structures are difficult, if not impossible, to remove in an emergency if the pressure inside the helmet is lower than the surrounding pressure. The relative vacuum inside the helmet prevents the breaking of the seal between the neck dam (or seal) ring and the helmet. All previously designed neck ring locks merely release the seal and do not mechanically part (or break) the seal.

There are several causes for a lower pressure to occur inside a helmet. These causes include parting of the air supply hose above the diver, loss of air supply during descent and loss of air supply during inhalation, etc. While all helmets are equipped with a non-return valve whose function is to prevent lower pressure when the hose parts, these valves sometimes fail.

Previously known structures of this type require two hands or two or more operations to release the latches of the metal ring from secured engagement with the helmet. This requires considerable time and presents unnecessary complex requirements for removal of the associated helmet. Further, the small diameter end of the neck seal or dam engaged about the neck of the user of the helmet is subject to ballooning and the escape of air from within the helmet through the neck dam. Of course, should a diver be disposed in a head downward position when the neck dam balloons sufficiently to release air from within the helmet, water from the exterior of the helmet is free to flow into the latter, at least to some restricted degree.

Examples of previously patented helmets including some of the structural features of the instant invention are disclosed in U.S. Pat. Nos. 2,383,261, 2,664,567, 3,030,626, 3,172,126, 3,534,408, 3,729,744 and 3,806,950.

BRIEF DESCRIPTION OF THE INVENTION

The helmet construction of the instant invention is adapted to be utilized without benefit of a full diving suit or with a specially designed full diving suit and is constructed in a manner whereby the helmet may be quickly removed from the head of the diver in the event of an emergency. Even if there exists a lower pressure (partial vacuum relative to the surrounding water) the clamp that secures the neck seal to the helmet mechanically breaks the seal between the neck seal and the helmet, allowing instant removal of the helmet and preventing serious damage to the diver which would result if the pressure continued to lower in the helmet, a condition which may occur due to a broken air supply line and non-return valve failure and which results in the diver experiencing "the squeeze", which condition can be fatal. Further, the helmet construction includes structure whereby it is readily adaptable for use by persons having different head and neck sizes.

It is also pointed out that the helmet construction of the instant invention is constructed in a manner whereby the neck dam thereof is not subject to ballooning resulting in the escape of air from within the helmet.

The main object of this invention is to provide a positive method of attaching a helmet to a diver's head by means of a semi-rigid or rigid neck yoke that closely fits the diver's neck and in effect extends the helmet structure to the neck. The primary intention is for use by undersea divers, but is not limited to that use.

Another object of this invention is to provide a diving helmet for use with or without a full diving suit and constructed in a manner whereby a fluid-tight seal may be maintained between the diving helmet and the neck of the user.

Still another object of this invention is to provide a diving helmet in accordance with the preceding objects and constructed in a manner whereby the helmet may be readily adapted for use in conjunction with divers having different head and neck sizes.

Still another object of this invention is to provide a diving helmet in accordance with the preceding objects and constructed in a manner whereby the helmet may be quickly removed from the head of the user by the latter and with little effort on the part of the diver and with mechanical means provided to automatically break the seal between the neck seal and the helmet.

A final object of this invention to be specifically enumerated herein is to provide a diving helmet in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
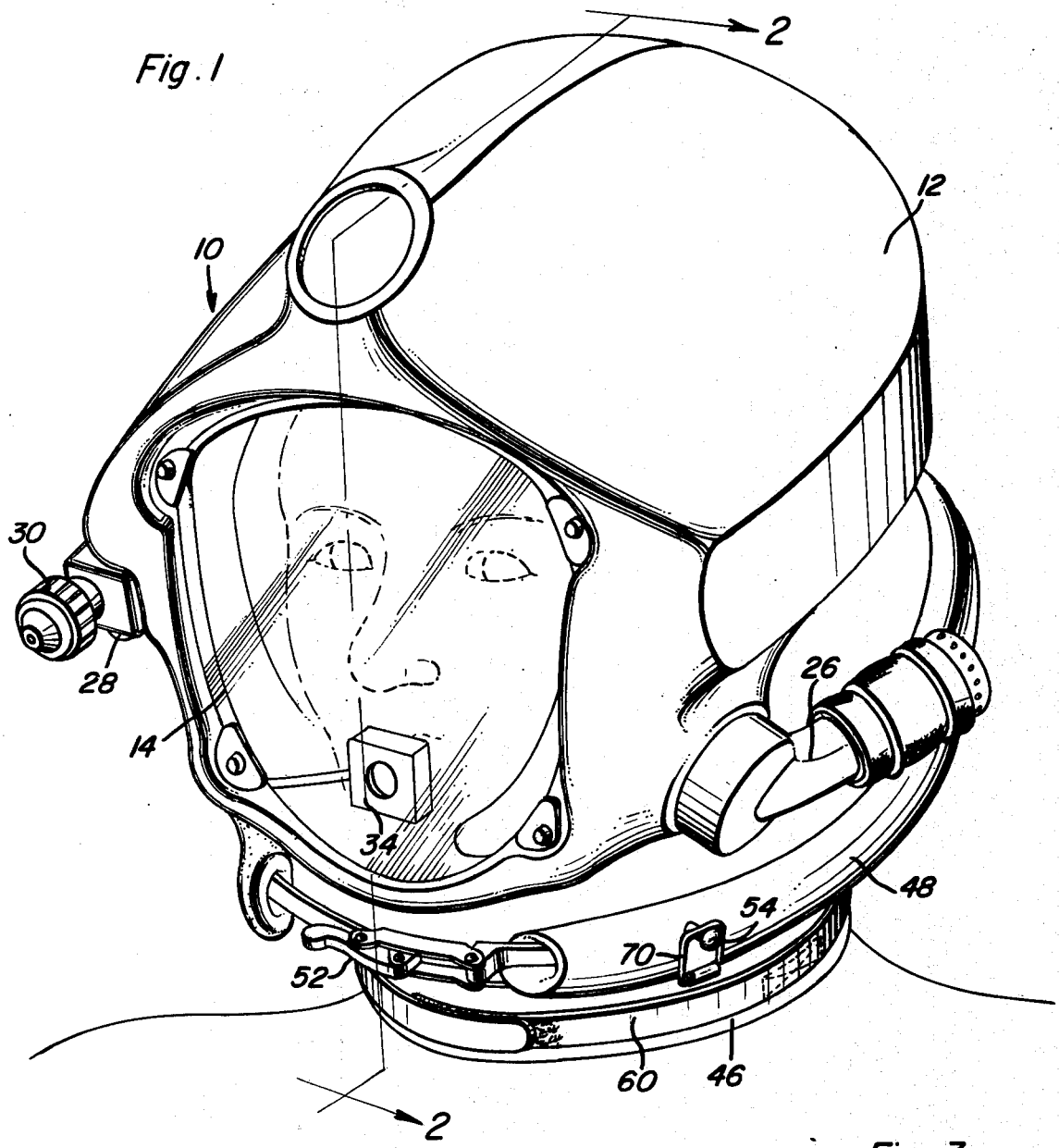
FIG. 1 is a perspective view of the helmet construction of the instant invention as applied to the head of a diver.
Figure 3:
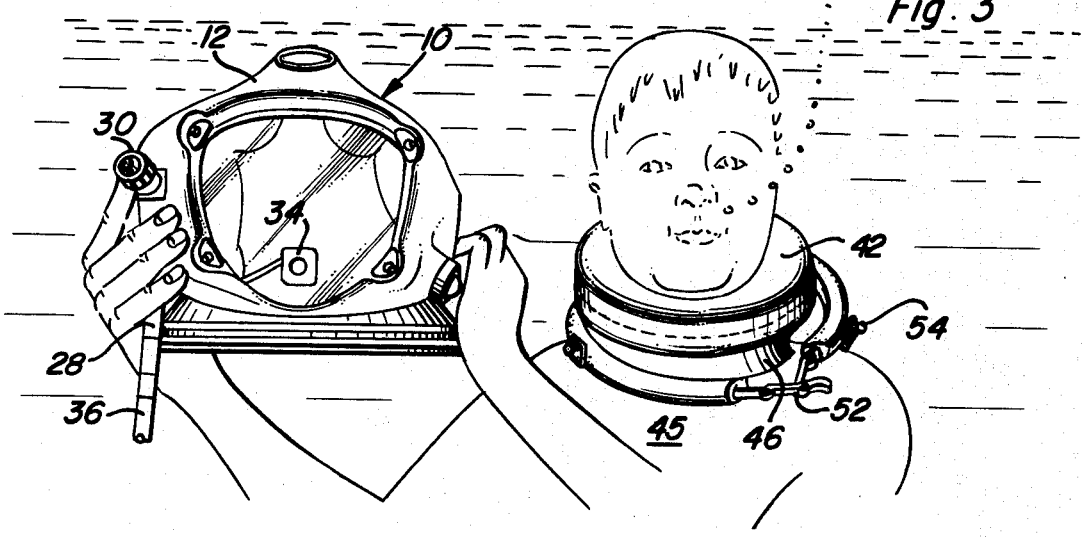
FIG. 3 is a perspective view of a diver with the body portion of the helmet removed from the head of the diver and the remaining components of the helmet construction disposed about the neck of the diver.

Referring now more specifically to the drawings the numeral 10 generally designates the helmet construction of the instant invention. The construction 10 includes a rigid helmet body 12 including a fluid-tight forward window 14 and a lower access opening 16 defined by a lower generally cylindrical portion 18 of the body 12. The inner surfaces of the cylindrical portion 18 are slightly inwardly convex and the outer surfaces of the cylindrical portion 18 define a groove 20 extending circumferentially thereabout, the groove 20 defining a central O-ring groove 22 having an O-ring 24 seated therein.

The body 12 includes an exhaust valve assembly 26 on the left side thereof and a breathing gas valve assembly 28 on the right side thereof, the valve assembly 28 including a valve control 30. Also, the helmet body 12 includes a waterproof electrical connection fitting 32 secured therethrough whereby an interior microphone 34 supported inwardly of the window 14 may be electrically connected to conductor wires (not shown) extending to the surface. Such connector wires may be suitably anchored to an air supply line 36 operatively coupled to the valve assembly 28.

The interior of the helmet body 12 is provided with a resilient cushioning member or liner 40 which may comprise either a body of resilient material or a hollow contoured bladder or cushion which is filled with liquid. In any event, the liner 40 includes rear and opposite side portions which terminate downwardly slightly above the cylindrical portion 18 of the body 12, the latter being constructed of reasonably rigid and fluid impervious material.

Figure 4:
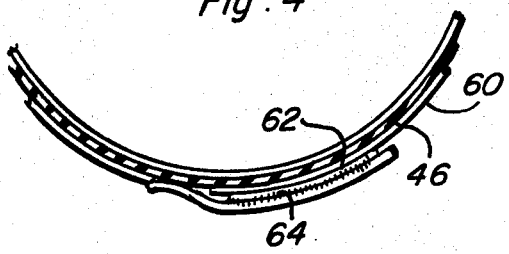
FIG. 4 is a fragmentary horizontal sectional view illustrating the manner in which the retaining strap applied about the lower portion of the neck dam of the helmet structure is utilized to secure the neck dam tightly about the neck of the user.
Figure 5:
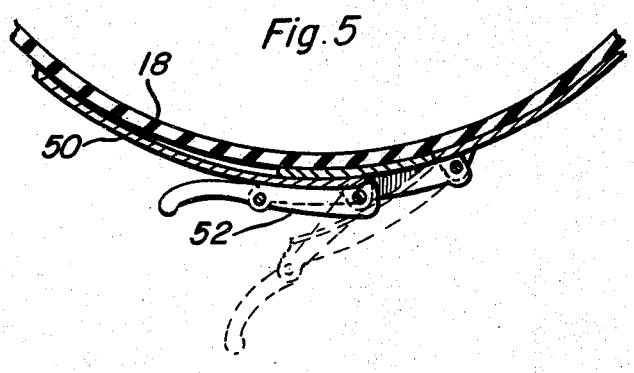
FIG. 5 is a fragmentary horizontal sectional view illustrating the manner in which the mounting ring of the helmet construction is utilized to tightly clampingly engage the outer surface portions of the lower end of the body of the helmet defining the access opening thereof and a release position of the mounting ring latch illustrated in phantom lines.
Figure 6:
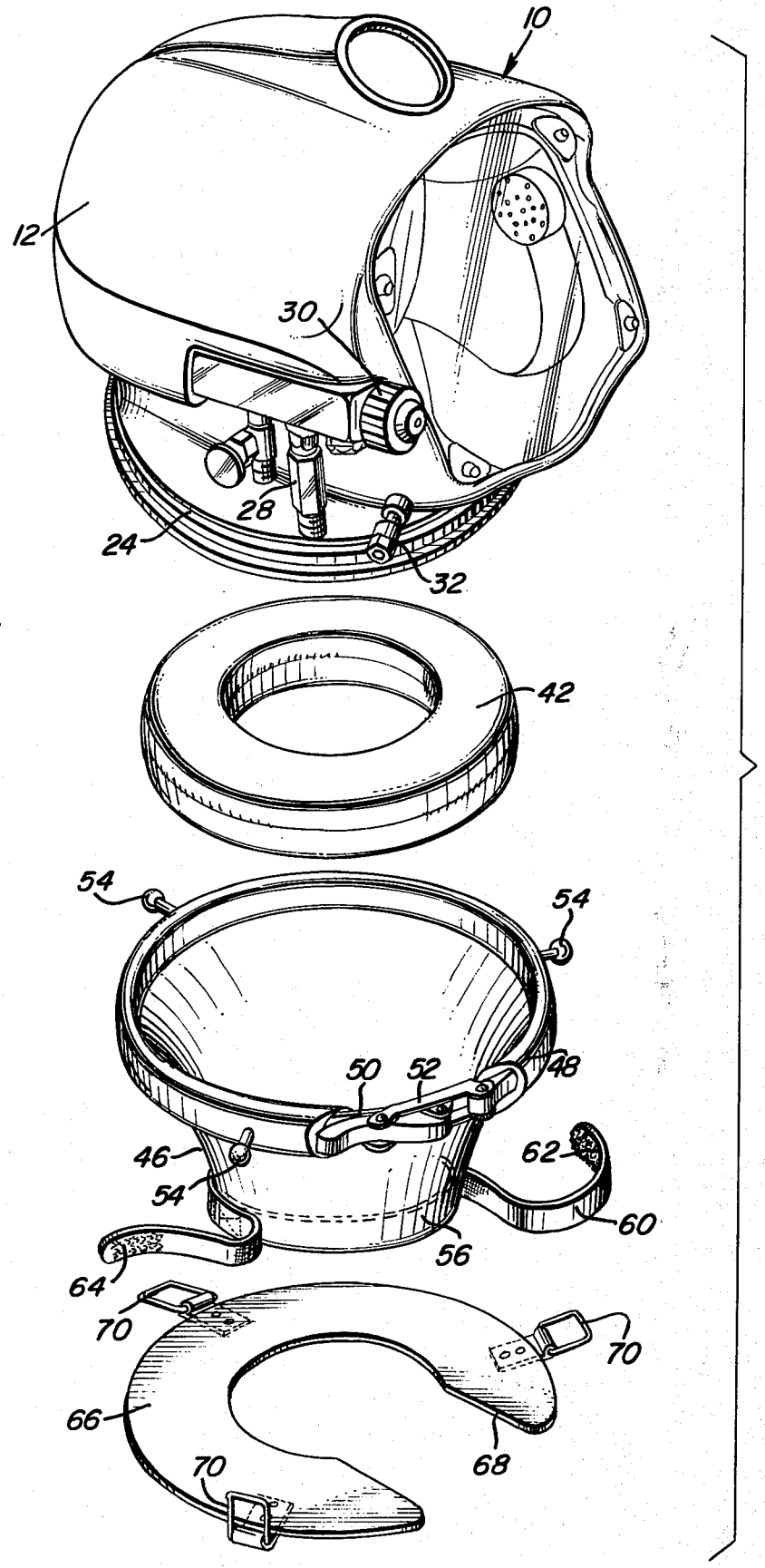
FIG. 6 is an exploded perspective view of the helmet construction.

A hollow doughnut shaped collar 42 is provided and is constructed of resilient deformable material and filled with a liquid or gas. The collar 42 is constructed in a manner whereby it may be stretched downwardly over the head 44 of the diver 45 and the helmet construction 10 further includes a hollow tubular neck dam 46 constructed of water impervious, flexible and stretchable material such as rubber or neoprene. The neck dam 46 is tapered and includes a large diameter end portion 48 folded outwardly and over a split anchoring ring 50 including an over-center toggle latch 52 secured between its opposite end portions. The ring 50 is of course constructed of rigid but somewhat flexible metal and may thus be circumferentially contracted and secured in a contracted condition by means of the toggle latch 52. The ring 50 is circumferentially expandable to mechanically force the parting of the existing seal when the over-center toggle latch 52 is pushed open. The ring 50 includes headed mounting pins 54 projecting outwardly therefrom at points spaced circumferentially thereabout through the outwardly and downwardly folded portion of the large diameter end portion 48 of the neck dam 46 and the lengthwise tapering neck dam 46 includes a small diameter end portion 56. When the anchor ring 50 has its toggle latch 52 released, it is expandable sufficiently to be displaced downwardly over the head 44 of the diver 45 with the small diameter end portion 56 of the neck dam 46 expanded so as to be receivable over the head 44 of the diver 45. When the small diameter end portion 56 of the neck dam 46 has passed downwardly over the head 44 of the diver 45, it is operable to snugly embrace the neck 58 of the diver 45. In addition, a flexible strap 60 is provided and includes coacting "Velcro" equipped end portions 62 and 64 which are removably securable together in the manner illustrated in FIG. 4 so as to snugly clamp the small diameter end portion 56 of the neck dam 46 about the neck 58 of the diver 45, after the lower end of the small diameter end portion 56 has been tucked upwardly under the adjacent portions of the neck dam 46, see FIG. 1.

In addition to the above described components, the helmet construction 10 further includes a C-shaped or horseshoe shaped yoke or thrust member 66 constructed of a rigid panel member and the yoke 66 defines an entrance throat 68 through one side thereof by which the yoke 66 may be applied about the neck 58 of the diver 45 after the neck dam 46. Also, the yoke 66 includes circumferentially spaced hingedly supported yoke buckles 70 which are swingable into upstanding positions for engagement with the headed mounting pins 54.

In operation, after the neck dam 46 has been slipped downwardly over the head 44 of the diver 45, the yoke 66 may be engaged about the neck 58 of the diver. Thereafter, the collar 42 is slipped downwardly over the head 44 of the diver and the helmet body 12 may then be applied to the head of the diver.

Figure 2:
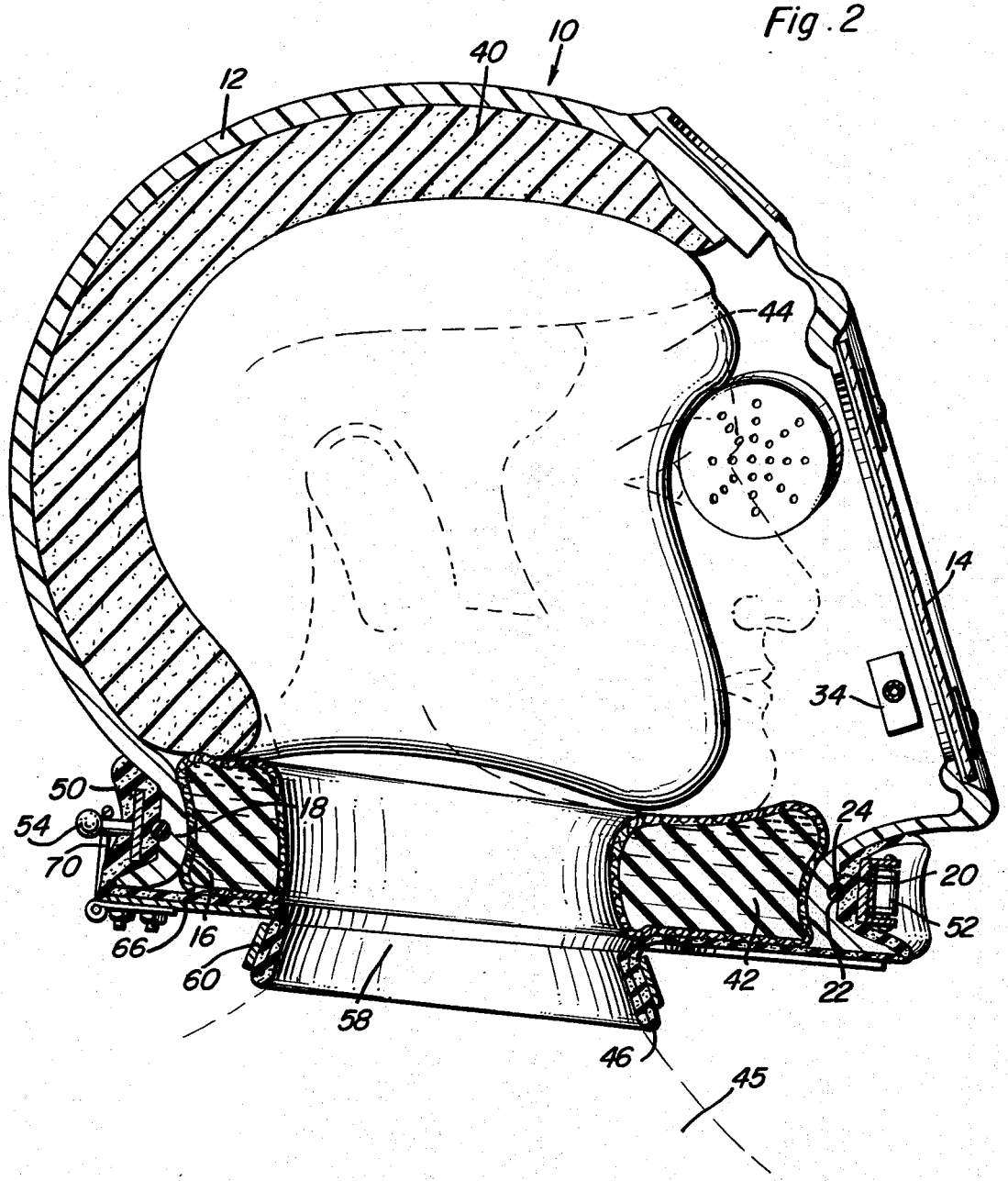
FIG. 2 is an enlarged fragmentary vertical sectional view taken substantially upon the plane indicated by the section line 2—2 of FIG. 1.

Thereafter, the collar 42 is upwardly displaced into the cylindrical portion 18 of the helmet body 12 in the manner illustrated in FIG. 2 of the drawings. Then, the anchor ring 50, with the toggle latch 52 in the release position, is displaced upwardly (with the yoke 66) into position with the anchor ring 50 seated in the groove 20 and the yoke 66 supported from the anchor ring 50 upwardly compressively engaged with the collar 42 thereby causing the latter to expand radially outwardly into tight fluid-sealed engagement with the convex inner surface portions of the cylindrical portion 18. Then, the toggle latch 52 is closed so as to circumferentially contract the anchor ring 50 into tight seated engagement within the groove 66 against the O-ring 24, and the anchor ring 50 may have the yoke buckles 70 engaged with the mounting pins 54. Thereafter, the small diameter end portion 56 of the neck dam 46 has its lower terminal end tucked under and upwardly beneath the adjacent portions of the neck dam 46 and the strap 60 is secured about the lower portion of the neck dam 46 in the manner illustrated in FIG. 2 of the drawings in order to insure a fluid-tight seal between the neck dam 46 and the neck 58 of the diver.

The yoke 66 compressively engages substantially all of the portions of the neck dam 46 between the upper surfaces of the yoke 66 and the undersurfaces of the collar 42 and the end surfaces of the cylindrical portion 18. Thus, excessive ballooning of the neck dam 46 is avoided.

After the helmet construction 10 has once been applied to the head 44 of the diver in the manner above set forth, should it be necessary for the diver to remove the helmet body 12, it is merely necessary for the toggle latch 52 to be opened in order that the anchor ring 50 may be displaced downwardly off the open lower end of the helmet body 12. Thereafter, the helmet body 12 may be readily removed from the head of the diver (even if a lower pressure had previously existed in the helmet) because the opening of the toggle latch expands the anchor ring 50 allowing pressure to equalize.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A diving helmet construction including a rigid helmet body having peripherally continuous front, opposite side and rear upstanding wall portions and an upper wall portion closing the upper end of said body, the lower portion of said body being open and defining an access opening, said front wall portion having a fluid-tight window, breathing air inlet and exhaust means opening through said body into the interior thereof from the exterior of said body, a resilient and axially compressible and radially expandable fluid impervious doughnut-shaped collar expandable downwardly over the head of a diver and snugly received within said access opening, an at least semi-rigid body defining a narrow neck receiving slot opening into a central void positioned beneath the open lower end of said helmet and said collar, a tubular, flexible expandable and fluid imperious neck dam provided at one end with clamp means removably clampingly engaged about the lower portion of said body defining said access opening, the other end of said neck dam being sealingly engageable with the neck of the user, said clamp means and yoke including releasably engaged coacting anchor structure releasably retaining said yoke and clamp ring against axial separation with the portions of said neck dam disposed between the opposite ends thereof clamped between said yoke and collar.

2. The combination of claim 1 wherein said yoke comprises a rigid panel-like member whereby to create a positive method of head attachment and preventing neck dam ballooning.

3. The combination of claim 1 wherein said clamp means comprises a peripherally extending adjustable length split ring constructed of stiff but somewhat resilient material and provided with coacting over-center toggle latch defining means on its opposite ends for releasably constracting said clamp ring about said lower portion of said body, said toggle latch defining means including means for expanding the clamp ring when the latch defining means is opened.

4. The combination of claim 1 wherein said helmet includes form retentive but at least somewhat resilient liner means on the inner surfaces of said opposite side and rear wall portions projecting inwardly therefrom and spaced above the portions thereof defining said access opening, said collar being upwardly abutted against the lower portions of said liner means and axially compressed between the latch and said yoke.

5. A diving helmet construction including a rigid helmet body having peripherally continuous front, opposite side and rear upstanding wall portions and an upper wall portion closing the upper end of said body, the lower portion of said body being open and defining an access opening, said front wall portion having a fluid-tight window, breathing air inlet and exhaust means opening through said body into the interior thereof from the exterior of said body, a resilient and axially compressible and radially expandable fluid impervious doughnut-shaped collar expandable downwardly over the head of a diver and snugly received within said access opening, a rigid yoke body defining a narrow neck receiving slot opening into a central void positioned beneath the open lower end of said helmet and said collar, form retentive but at least somewhat resilient liner means on the inner surface of said opposite side and rear wall portions projecting inwardly therefrom and spaced above the portions thereof defining said access opening, and a thrust member disposed beneath said collar, removably anchored to said portions of said helmet surrounding said access opening and axially compressing said collar between said thrust member and said liner means to thereby radially expand said collar into tight sealed engagement with the inner surfaces of said portions of said helmet surrounding said access opening and into at least reasonably good sealed engagement with the neck of the user of said helmet.

6. A diving helmet construction including a rigid helmet body having a peripherally continuous front, opposite side and rear upstanding wall portions and an upper wall portion closing the upper end of said body, the lower portion of said body being open and defining an access opening, said front wall portion having a fluid-tight window, breathing air inlet and exhaust means opening through said body into the interior thereof from the exterior of said body, a tubular, flexible, expandable and fluid impervious neck dam provided at one end with a peripherally extending adjustable clamp ring removably clampingly engaged about the lower portion of said body defining said access opening, the other end of said neck dam being sealingly engageable with the neck of the user, said clamp ring comprising a split ring constructed of stiff but somewhat resilient material and provided with coating over-center toggle latch defining means on its opposite ends for releasably contracting said clamp ring about said lower portion of said body, said toggle latch defining means including means for expanding the clamp ring when the latch defining means is opened.

7. The combination of claim 6 including a rigid yoke body defining a narrow neck receiving slot opening into a central void positionable beneath the open lower end of said body said clamp ring and yoke including releasably engaged coacting anchor structure releasably retaining said yoke and clamp ring against axial separation with the portions of said neck dam disposed between the opposite ends thereof clamped between said yoke and the open lower end of said body.

8. The combination of claim 6 including a resilient and axially compressible and radially expandable fluid impervious doughnut-shaped collar expandable downwardly over the head of a diver and snugly received within said access opening, means engaged with the axial faces of said collar compressively engaging the latter for radially expanding said collaar within said access opening and snugly about the neck of the user of the helmet, said helmet including form retentive but at least somewhat resilient liner means on the inner surfaces of said opposite side and rear wall portions projecting inwardly therefrom and spaced above the portions thereof defining said access opening, said liner means comprising a portion of said means compressively engaging said collar.

* * * * *